US006454639B1

(12) United States Patent
Huber

(10) Patent No.: US 6,454,639 B1
(45) Date of Patent: Sep. 24, 2002

(54) CLAMPING DEVICE FOR GRINDING DISCS

(75) Inventor: Johann Huber, Kramsach (AT)

(73) Assignee: Tyrolit Schleifmittelwerke Swarovski KG, Schwaz (AT)

( * ) Notice: Subject to any disclaimer, the term of this patent is extended or adjusted under 35 U.S.C. 154(b) by 0 days.

(21) Appl. No.: 09/700,083

(22) PCT Filed: Nov. 8, 1999

(86) PCT No.: PCT/AT99/00269

§ 371 (c)(1),
(2), (4) Date: Nov. 9, 2000

(87) PCT Pub. No.: WO00/27590

PCT Pub. Date: May 18, 2000

(30) Foreign Application Priority Data

Nov. 10, 1998 (AT) ..... 1865/98

(51) Int. Cl.[7] ..... B24B 45/00
(52) U.S. Cl. ..... 451/342; 451/359; 451/548
(58) Field of Search ..... 451/342, 359, 451/540, 548; 125/15

(56) References Cited

U.S. PATENT DOCUMENTS 4,541,205 A * 9/1985 Patrello ..... 451/342
4,754,577 A * 7/1988 MacKay, Jr. ..... 15/230.18
4,850,154 A * 7/1989 Grammer et al. ..... 451/548
4,998,384 A * 3/1991 Bouchard et al. ..... 451/342
5,259,145 A * 11/1993 Fushiya et al. ..... 451/342
5,468,176 A * 11/1995 Udert et al. ..... 451/342
5,560,348 A * 10/1996 Markley et al. ..... 125/15
5,584,753 A * 12/1996 Takahashi ..... 451/342
5,895,317 A * 4/1999 Timm ..... 451/359
6,071,185 A * 6/2000 Genau et al. ..... 451/541
6,332,836 B1 * 12/2001 Tseng ..... 451/359

* cited by examiner

*Primary Examiner*—Timothy V. Eley
*Assistant Examiner*—David B. Thomas
(74) *Attorney, Agent, or Firm*—Wenderoth, Lind & Ponack, L.L.P.

(57) ABSTRACT

The invention relates to a clamping device for grinding discs (3, 4) having clamping elements which are formed by a clamping flange (1) and a clamping nut (2). A rigid, preferably metallic intermediate ring (5) is arranged between a clamping element and the grinding disc (3, 4). The intermediate ring distances the grinding disc (3, 4) from the clamping element. The intermediate ring (5) or the clamping element adjacent to the intermediate ring (5) is provided with a fixed damping layer (9, 12, 14, 20) made of an elastic material. The damping layer extends in both a radial and an axial direction.

9 Claims, 5 Drawing Sheets

CLAMPING DEVICE FOR GRINDING DISCS

The invention relates to a clamping device for grinding wheels comprising clamping elements which are formed by two clamping flanges or a clamping flange and a clamping nut, and possibly a damping insert.

It is known that the generation of noise when carrying out a grinding operation, in particular when carrying out a grinding operation by means of hand-guided tools, contributes substantially to the high level of noise pollution which occurs at many workplaces. That applies in particular in regard to metal machining.

In order to reduce the generation of noise in a grinding operation, low-noise grinding wheels have already been developed. Admittedly that certainly resulted in a reduction in the level of noise pollution, but on the other hand it resulted in a lower level of removal of the grinding wheels, whereby working progress and viability of the grinding wheels were substantially reduced.

DE 43 28 987 C1 shows the incorporation of separate elastic inserts in clamping systems, with the aim of permitting clamping or dimensional compensation or equalisation.

DE 195 12 991 discloses a clamping arrangement for use in a turning tool, with which vibrations of a tool element are to be absorbed. At the same time durability is to be improved. The structure shown in the specification referred to suffers from the disadvantage that vibrations in a radial direction cannot be damped by virtue of the disk-shaped configuration of the elastic insert.

The object of the invention is to improve a clamping device of the kind set forth in the opening part of this specification, in such a way that, when using a conventional grinding wheel, without particular damping, a reduction in noise generation is achieved.

The object according to the invention is attained in that arranged between at least one clamping element and the grinding wheel is a stiff, preferably metal intermediate ring which spaces the grinding wheel from the clamping element and that the intermediate ring or the clamping element adjacent to the intermediate ring is provided with a fixed damping layer of elastic material, which extends both in the radial and also the axial direction.

Advantageously, it is provided that the clamping element, the damping layer and the intermediate ring are connected together to form one piece, preferably being glued together.

A further advantage of the invention is that the damping layer extends both in the radial and also the axial direction and an enhanced service life is achieved for the grinding wheel, with a reduced level of noise and vibration pollution.

Figure 5:
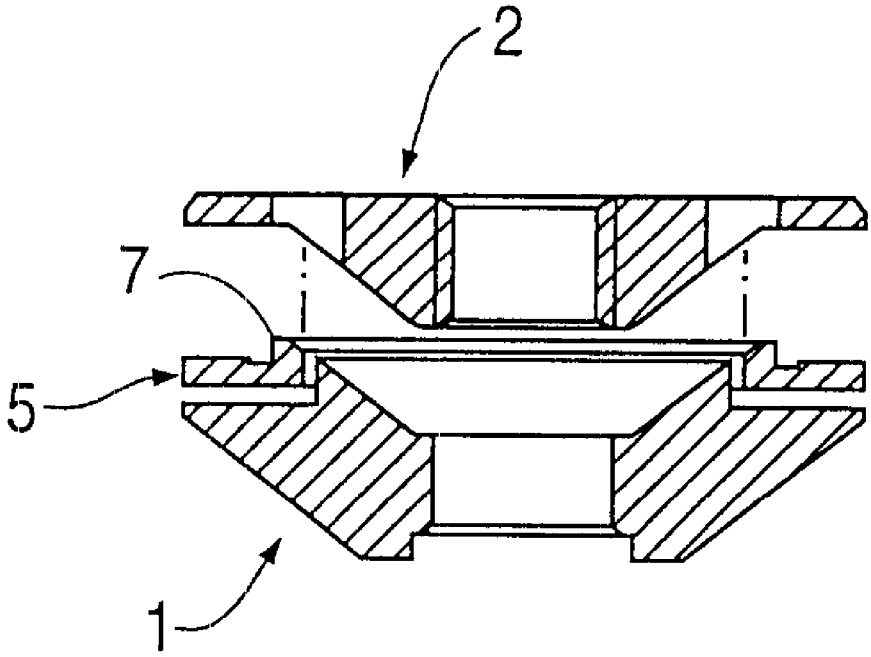

Various embodiments of the invention are described hereinafter with reference to the Figures of the accompanying drawings in which:

FIGS. 1 through 4 are views in section through various embodiments of a clamping device according to the invention in which a respective grinding wheel is clamped, and FIG. 5 is a view in section through a clamping device according to the invention, with the parts of the clamping device being shown separated from each other.

The clamping device according to the invention comprises two clamping elements, wherein in the illustrated embodiments one of the clamping elements is formed by a clamping flange 1 and the second clamping element is formed by a clamping nut 2. The invention can however also be used in relation to a clamping device having two clamping flanges.

In accordance with the invention the clamping flange 1 is provided with a damping layer 9. In addition, in the illustrated embodiments, disposed between the clamping flange 1 and the grinding wheel 3, 4 is an intermediate ring 5 which is preferably made from the same material as the clamping flange 1 and the clamping nut 2, for example cast steel or sheet steel.

Figure 1:
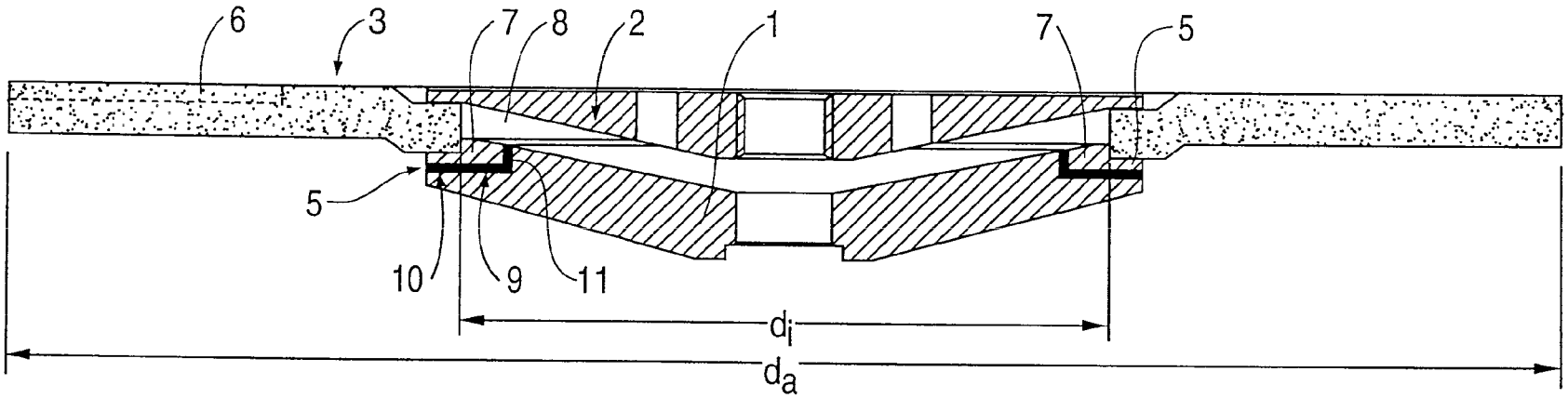

In the embodiment shown in FIG. 1, clamped in the clamping device is a grinding wheel 3 which is in the form of a cranked roughing grinding wheel with an annular coarse-grinding layer 6.

The intermediate ring 5 has a projection 7 which faces towards the clamping nut 2 and which projects into the hub opening 8 of the grinding wheel 3 and which in the illustrated embodiment bears internally against the grinding wheel 3.

Disposed between the intermediate ring 5 and the clamping flange 1 is a damping layer 9 comprising an elastomer material. The damping layer 9, like the intermediate ring 5, is of an annular configuration and has a disk-shaped region 10 and a sleeve-shaped region 11.

The diameter of the hub opening 8 of the grinding wheel 3 is more than a quarter of the outside diameter of the grinding wheel 3.

Due to that size ratio, the grinding wheel 3 is stiffer in use. The waste which occurs is smaller in relation to the overall mass of the grinding wheel 3 and the proportion of the damping mass of the damping layer 9 can be increased in relation to the mass of the grinding wheel 3.

In that way, with the same material removal rate, it is possible to achieve a 50% increase in service life of the grinding wheel 3.

Figure 2:
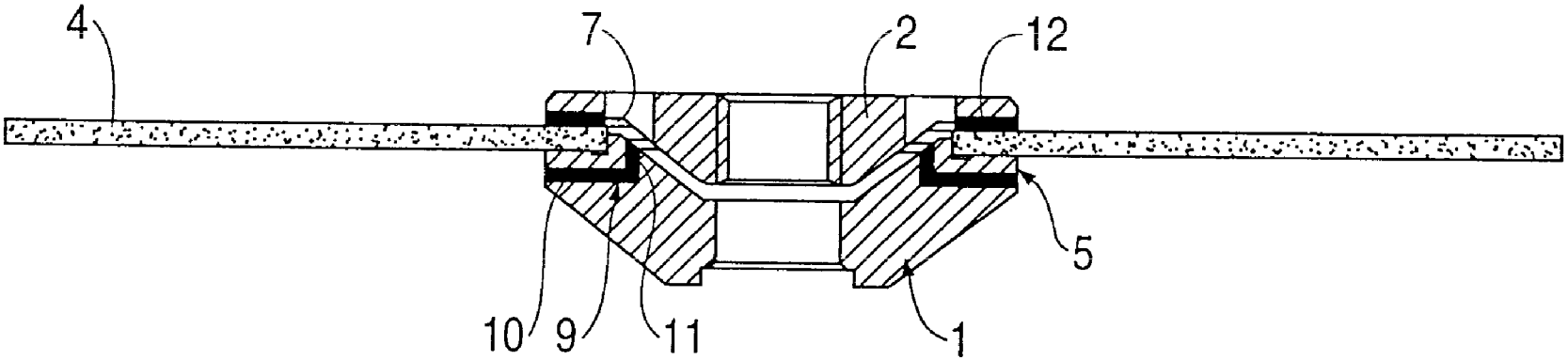

In the embodiment shown in FIG. 2 the clamping device according to the invention is provided with a grinding wheel 4 which is in the form of a severing wheel. The clamping device again has a clamping flange 1, a clamping nut 2 and an intermediate ring 5; similarly to the embodiment described above, this embodiment has a damping layer 9 and a further annular damping layer 12 which is disposed between the grinding wheel 4 and the clamping nut 2.

Figure 3:
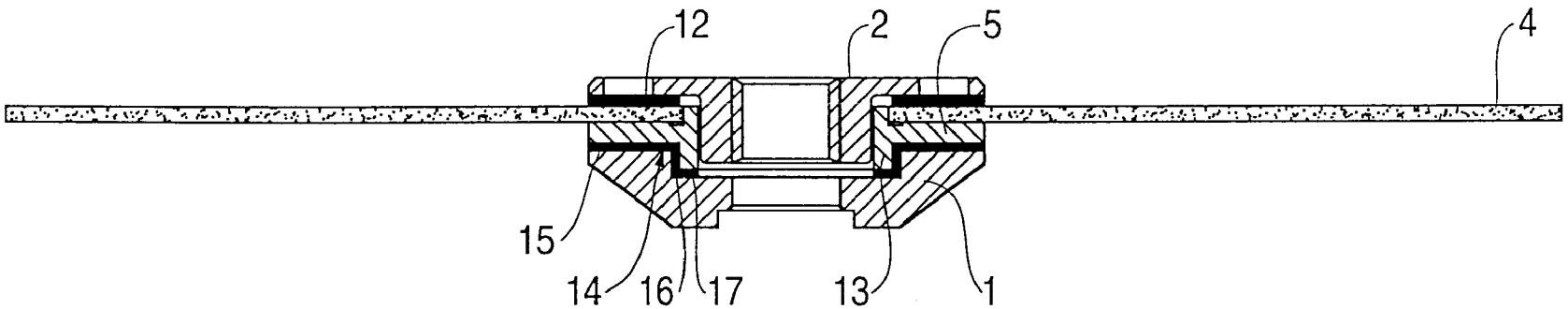
Figure 4:
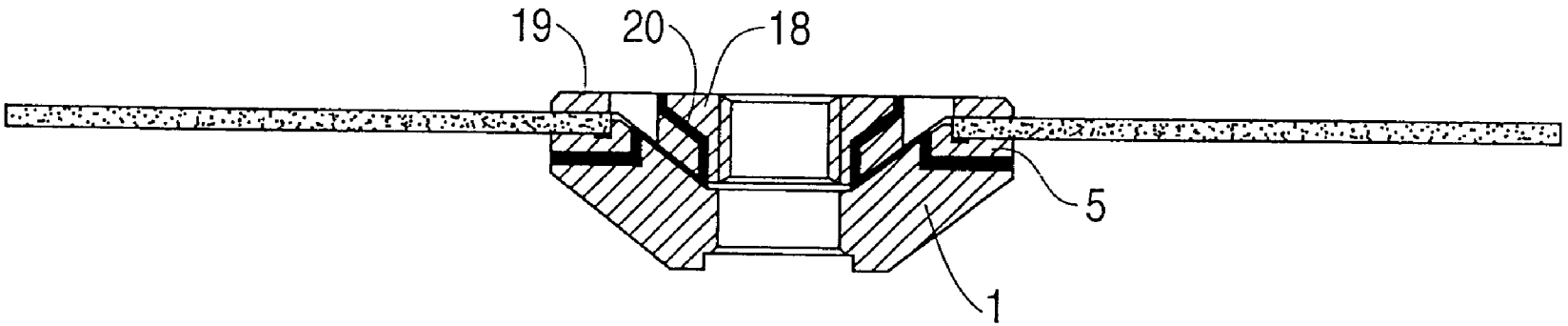

In the embodiment shown in FIG. 3 a grinding wheel 4 in the form of a severing wheel is again held in the clamping device. On the hub side, the intermediate ring 5 is provided with a sleeve-shaped projection 13 which projects on both sides of the intermediate ring 5. The damping layer 14 between the clamping flange 1 and the intermediate ring 5 has a radial portion 15, an axial portion 16 which is arranged between the sleeve-shaped projection 13 and the clamping flange 1, and a further radial portion 17 which separates the sleeve-shaped projection 13 of the intermediate ring 5 from the clamping flange 1. A clearance is provided between the sleeve-shaped projection 13 and the sleeve-shaped region of the clamping nut 2.

At the side associated with the clamping nut 2, the sleeve-shaped projection 13 projects into the hub opening 8 of the grinding wheel 4.

A damping layer 12 is again provided between the grinding wheel 4 and the clamping nut 2. The damping layer 14 serves at the same time as an adhesive layer so that the parts 1 and 5 can be handled by the user as a common component.

In the embodiment shown in FIG. 5, once again the intermediate ring 5 is connected to the clamping flange 1 by way of a damping layer 9 which is also in the form of an adhesive layer.

The clamping nut 2 is formed by a core portion 18 and an outer ring portion 19. Those two portions are again glued by means of a damping layer 20 which is formed for example by a butyl rubber.

In the illustrated embodiments the clamping nut 2 is screwed in conventional manner to the output shaft of a grinding machine, for example a hand grinding machine.

What is claimed is:

1. A clamping device for grinding wheels comprising clamping elements wherein arranged between at least one clamping element and a grinding wheel is a stiff intermediate ring which spaces the grinding wheel from the clamping element and wherein the intermediate ring or the clamping element adjacent to the intermediate ring is provided with a fixed damping layer of elastic material, which extends both in the radial and also the axial direction, characterized in that the intermediate ring has a sleeve-shaped projection on a hub side and that the intermediate ring and the clamping element are fixedly connected to form one piece by the damping layer of elastic material, which extends both in the radial and in the axial direction.

2. A clamping device as set forth in claim 1 characterized in that said intermediate ring is made of metal.

3. A clamping device as set forth in claim 1 characterized in that the clamping element, the damping layer and the intermediate ring are glued together.

4. A clamping device as set forth in claim 1 characterized in that the clamping elements are formed by two clamping flanges, and that one clamping flange is provided with the fixed intermediate layer of elastic material.

5. A clamping device as set forth in claim 1 characterized in that the clamping elements are formed by a clamping flange and a clamping nut, and that the clamping flange is provided with the fixed intermediate layer of elastic material.

6. A clamping device as set forth in claim 1 characterized in that a further damping layer is arranged at the side of the grinding wheel, which is opposite to the intermediate ring.

7. A clamping device as set forth in claim 6 characterized in that said further damping layer bears against the grinding wheel.

8. A clamping device as, set forth in claim 1 characterized in that the projection projects from opposite sides of the intermediate ring.

9. A clamping device as set forth in claim 1 characterized in that the damping layer is formed by an elastomer material.

* * * * *